United States Patent [19]

Lothrop

[11] 4,410,203

[45] Oct. 18, 1983

[54] MULTI-PURPOSE LABELLING

[75] Inventor: George A. Lothrop, Medfield, Mass.

[73] Assignee: Dennison Manufacturing Company, Framingham, Mass.

[21] Appl. No.: 195,267

[22] Filed: Oct. 8, 1980

[51] Int. Cl.[3] ..... G09F 3/00

[52] U.S. Cl. ..... 283/81; 156/239

[58] Field of Search ..... 156/230, 234, 289, 235, 156/239, 540, 344, 247; 283/18, 21, 81; 428/40, 41, 42, 195, 202

[56] References Cited

U.S. PATENT DOCUMENTS

| | | | |
|---|---|---|---|
| 3,226,862 | 1/1966 | Gabruk | 283/21 |
| 3,383,121 | 5/1968 | Singer | 283/21 |
| 3,574,029 | 4/1971 | Ettre | 156/344 X |
| 3,690,909 | 9/1972 | Finley | 156/230 X |
| 3,741,847 | 6/1973 | Sato | 156/384 |
| 3,985,602 | 10/1976 | Stuart | 156/235 |
| 4,277,089 | 7/1981 | Lockhart | 283/21 X |

*Primary Examiner*—Thurman K. Page

*Attorney, Agent, or Firm*—George E. Kersey; Arthur B. Moore; Barry D. Josephs

[57] ABSTRACT

Multi-purpose labelling making use of composite label structures which can be applied manually or by machine. The composite label structure includes at least an outer label that is temporarily held on an intermediate carrier by a suitable adhesive. The intermediate carrier is in turn releasably adhered to a base carrier.

In use of the composite structure, the outer label and intermediate carrier are separated from the base carrier and applied to an item of inventory. The composite of the label and intermediate carrier are then used when the item is subsequently processed, for example, by removing the outer label from the intermediate carrier and transferring it for inventory control or other processes.

6 Claims, 3 Drawing Figures

FIG. 1
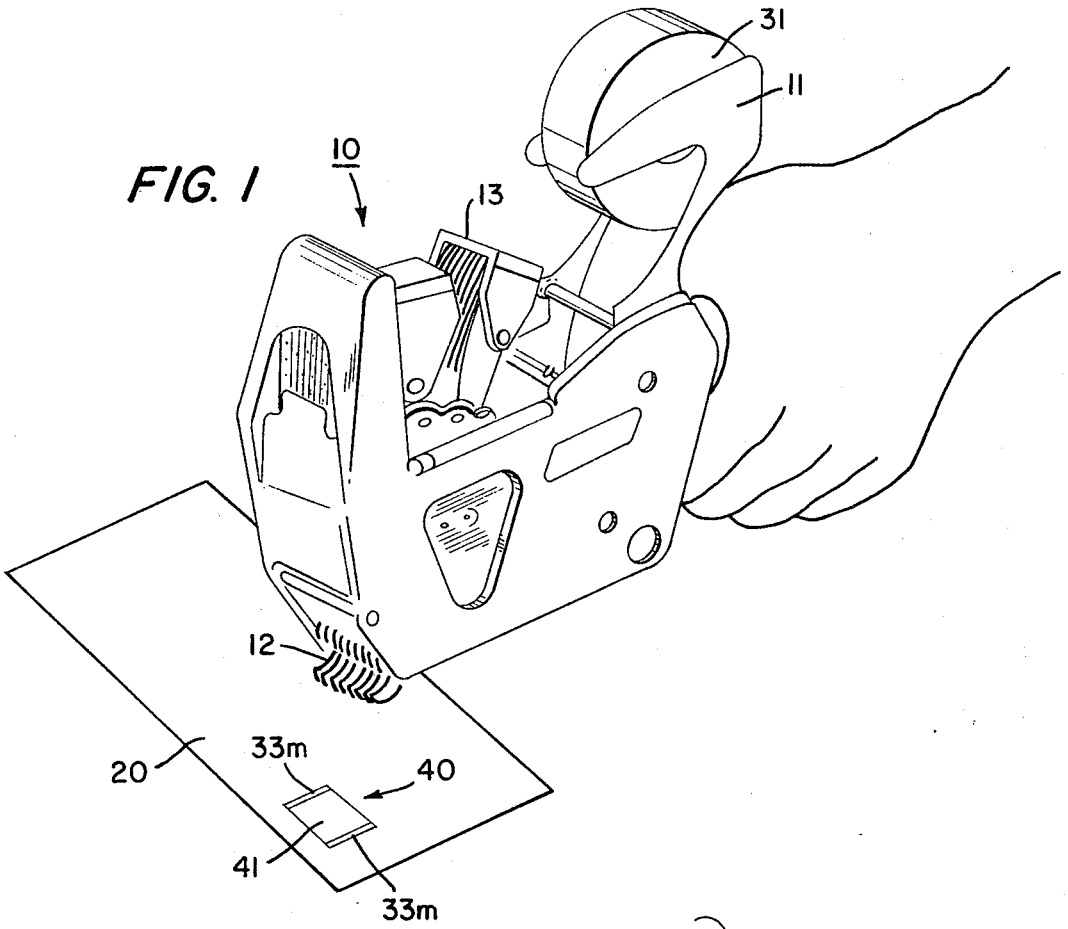
FIG. 2
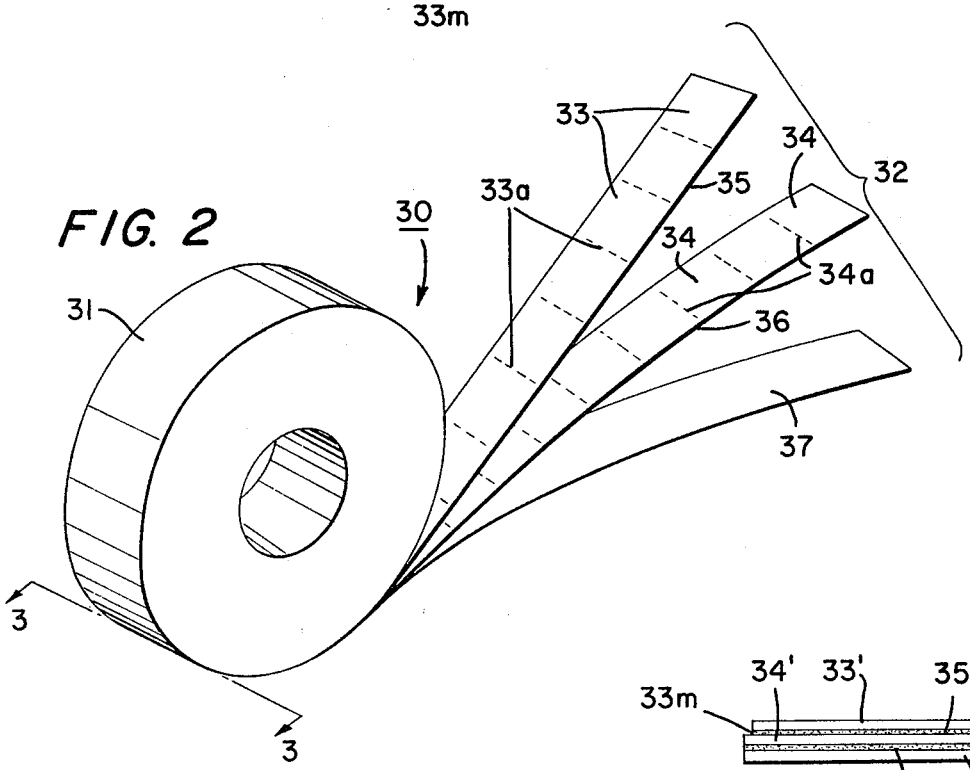
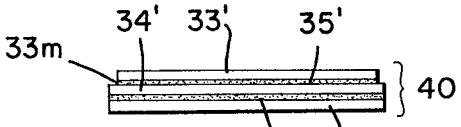
FIG. 3

MULTI-PURPOSE LABELLING

BACKGROUND OF THE INVENTION

This invention relates to the multi-purpose labelling of objects and more particularly to such labelling for inventory control or other purposes.

It has become common practice to apply a variety of labels to items in inventory. The labels carry data and information that relate to the item in inventory and its intended mode of use. Such labels are advantageously dispensed in roll form using a hand labeller which feels series connected labels that have a backing to protect an adhesive undercoating by which the labels are secured to the items being labelled. In the operation of the typical hand labeller the label and its backing is fed from a roll to a station where a desired imprint is made. Subsequently the label is separated from the backing, to expose an undercoating of pressure sensitive adhesive. The label is then applied with its adhesive coating surface against the object that is being labelled. When such an item is withdrawn from inventory it frequently is necessary to make an entry on, for example, a log book or other register to indicate the nature and use of the item that has been withdrawn. This entry can be made manually, or even by machine, but that is time consuming and burdensome. This is particularly true in facilities where large numbers of different medications are in stock and used in a large variety of ways. It is also true in situations where items held in stock are not all standard. The amount of effect required in keeping track of the various items can be significant. There is also a possibility of error, and misuse of the item, by the making of an improper entry in data cards associated with the item.

Accordingly it is an object of the invention to facilitate the usage and record keeping associated with items of inventory. A related object is to facilitate such usage in record keeping of stock which includes a large number of items with varied applications.

Another object of the invention is to promote record keeping for items without requiring the manual or machine entry of information on record keeping cards and the like.

SUMMARY OF THE INVENTION

In accomplishing the foregoing and related objects the invention provides a labelling structure and method of use in which one or more outer labels with an adhesive undercoating are positioned upon an intermediate carrier, which is in turn positioned upon a base carrier.

The composite label structure includes a label, a coextensive undercoating of pressure sensitive adhesive, an intermediate carrier, which also is undercoated with pressure sensitive adhesive, and finally a base carrier.

The base carrier, which is desirably continuous plays the normal role associated with the dispensing of labels with pressure sensitive adhesive coatings, i.e. it provides protection for the overlying superstructure until it is ready for use.

In accordance with one aspect of the invention the intermediate carrier is releasably adhered to the base carrier and an outer label is releasably adhered to the intermediate layer. In accordance with a further aspect of the invention the outer label and the intermediate carrier have different release characteristics which can be achieved for example by employing them with different types of release paper.

In accordance with still another aspect of the invention the outer layer has a margin with respect to an underlying intermediate carrier in order to facilitate subsequent removal of the outer label from the intermediate carrier. The intermediate carrier desirably consists of individual members, as do the other labels.

In accordance with yet a further aspect of the invention multi-purpose labelling is achieved by releasably dispensing a duplex labelling structure from a base carrier and subsequently removing an outer label from the duplex structure and applying it as needed. The outer label is releasably secured to the intermediate carrier and the intermediate carrier is releasably secured to the base carrier in order to facilitate the dispensing and subsequent removal operations.

DESCRIPTION OF THE DRAWINGS

Other aspects of the invention will become apparent after considering several illustrative embodiments taken in conjunction with the drawings in which:

FIG. 1 is a respective view showing a hand labeller being used to apply labels in accordance with the invention;

FIG. 2 is a perspective view of a roll of labels for the hand labeller of FIG. 1, with the leading portion separated to show the individual constituents of a composite label structure in accordance with the invention; and FIG. 3 is a cross sectional view of a composite label structure in accordance with the invention.

DETAILED DESCRIPTION

With reference to the drawings FIG. 1 shows a hand labeller 10 being used to apply composite labels in accordance with the invention, for example to a card 20. It will be understood that the object or item being labelled can have a wide variety of shapes and that the card 20 is merely illustrative.

A composite label structure in accordance with the invention is provided in the form of a roll 31 which is mounted on a holder 11 for being dispersed by the gun 10. The lead end of the roll 31 (not visible in FIG. 1) is threaded through the interior of the gun 10 to permit proper feed from the dispensing end 12. An illustrative dispenser gun is that shown in U.S. Pat. No. 3,741,847, issued June 26, 1973. It will be understood that the gun 10 is illustrative only and that a wide variety of other dispensing machines and dispensing techniques can be used with labels in accordance with the invention. In some cases the labels can be dispensed and applied manually.

When the labels are applied using the gun 10 of FIG. 1 it is customary to provide a printing station 13 by which a suitable legend is imprinted on the outer surface of the label structure. When a label has been dispensed on the card 20 it appears as a duplex label structure 40 with, for example, an imprint 41 that has been applied at the print station 13 and can be used for data control and processing purposes.

The roll 31 of the tape structure 30 in FIG. 2 is shown with its lead portion 32 separated to illustrate the various constituents of the overall structure. The first component is a successive set of individual outer labels 33 which are releasably adhered to an intermediate carrier 34. The latter also consists of a successive set of members. The outer labels 33 are adhered to the intermediate carrier member 34 by an adhesive 35 on the underside of each outer label 33. The individual intermediate carriers 34 are in turn releasably secured by an adhesive 36 to a base carrier 37, which is continuous in FIG. 2.

A cross sectional view of the composite label structure 30 is shown in FIG. 3. It includes the duplex label 40, which corresponds to the duplex label 40 shown applied to the inventory control card 20 of FIG. 1. The duplex label 40 is positioned upon a base carrier member 37'. The duplex label 40' includes both an outer label 33' and an intermediate carrier member 34'. The underside of the outer label 33' bears an adhesive layer 35' and the underside of the intermediate carrier 34' bears an adhesive layer 36'.

When the overall label structure is used with a machine 10 like that of FIG. 1, the continuous base carrier 37 is separated (split) from the duplex portion of the structure within the machine and exits from the rear, after having served its function of protecting the adhesive coating 36 of the intermediate carrier 34 during the machine operation prior to dispensing. The carrier 37 also holds the duplex labels 40 onto the carrier and positions them for dispensing. The outer labels 33 of the duplex structure 40 have margins 33m to facilitate subsequent removal of the outer labels 33 from the intermediate carriers 34.

The separation of the outer labels 33 from one another is illustrated by a dashed line **33*a* in FIG. 2. It will be appreciated that the dashed line 33*a* is merely representative of a wide variety of techniques for providing individual labels. The dashed line 33*a* may represent a distance of separation between adjoining labels i.e. for laid on labels. Or it can represent the cutting line for contiguous labels i.e. butt-coat labels. In some cases the line of separation 33*a*** can be eliminated completely where the machine itself contains an internal cutter.

Another important characteristic of the composite label structure 30 is that it is proportioned to facilitate subsequent dispensing and removal operations. There is a differential release characteristic for the various carriers 34 and 37. The duplex composite 40 is more readily releasable from the base carrier 37 than is the outer label 33 releasable from the intermediate carrier 34. One reason is that low release of the intermediate carrier 34 from the base carrier 37 is desirable for machine dispensing. The duplex structure 40, on the other hand, may be applied to comparatively rough and uneven surfaces, where it is important for the outer label 33 to be more securely retained until it is ready to be removed for use.

The desired variable release characteristic can be achieved in a variety of ways. The thickness of the applied adhesive layer can be controlled, a thicker layer being used where greater adhesion is desired before release. Another effective and efficient way from a production standpoint is to apply the same adhesive weight to both carriers and provide a different release coating for the respective carriers. In this case the coating on the base carrier provides less retension than the coating on the intermediate carrier.

While various aspects of the invention have been set forth by the drawings and the specifications, it is to be understood that the foregoing detailed description is for illustration only and that various changes in parts, as well as the substitution of equivalent constituents for those shown and described, may be made without departing from the spirit and scope of the invention as set forth in the appended claims.

I claim:

1. A multipurpose label structure consisting of a base carrier, an adhesive superimposed on said base carrier, an intermediate label releasably superimposed upon said adhesive, a further adhesive superimposed upon said intermediate label, an outer label releasably superimposed upon said further adhesive, wherein said outer label and said intermediate label have different release characteristics.

2. A labelling structure in accordance with claim 1 wherein the different release characteristics are achieved using different types of release paper.

3. A labelling structure in accordance with claim 1 wherein said outer label has a margin with respect to an underlying intermediate carrier.

4. A labelling structure in accordance with claim 1 wherein the base carrier is a continuous strip.

5. A labelling structure in accordance with claim 1 wherein the intermediate carrier consists of individual members.

6. A labelling structure in accordance with claim 1 wherein the outer labels consist of individual members.

* * * * *